US006099048A

United States Patent [19]

Salmon et al.

[11] Patent Number: 6,099,048

[45] Date of Patent: Aug. 8, 2000

[54] AUTOMOTIVE DOOR LATCHING SYSTEM

[75] Inventors: James Lee Salmon, Ann Arbor; Quang Vinh Nguyen, Canton; James Joseph Loschiavo, Livonia; Richard Kollar, Riverview, all of Mich.

[73] Assignee: Ford Global Technologies, Inc., Dearborn, Mich.

[21] Appl. No.: 09/262,271

[22] Filed: Mar. 4, 1999

[51] Int. Cl.[7] ..... E05C 3/06

[52] U.S. Cl. ..... 292/216; 292/201; 292/DIG. 23

[58] Field of Search ..... 292/216, 201, 292/DIG. 23, DIG. 43, 144, 11, 24, 44, DIG. 3; 70/265, 283

[56] References Cited

U.S. PATENT DOCUMENTS

| | | | |
|---|---|---|---|
| 784,064 | 3/1905 | Nordenberg | 70/265 |
| 1,789,113 | 1/1931 | Pierce | 292/DIG. 3 |
| 2,166,058 | 7/1939 | Kirk | 70/265 |
| 3,154,938 | 11/1964 | Cohen | 70/265 |
| 3,645,043 | 2/1972 | Velavicius et al. | 49/370 |
| 4,322,959 | 4/1982 | Mochida | 70/241 |
| 4,998,758 | 3/1991 | Kowalczyk et al. | 292/201 |
| 5,035,449 | 7/1991 | Shiratori et al. | 292/48 |
| 5,137,311 | 8/1992 | Brackmann | 292/216 |
| 5,245,879 | 9/1993 | McKeon | 74/2 |
| 5,413,402 | 5/1995 | Flerchinger et al. | 298/23 M |
| 5,613,716 | 3/1997 | Cafferty | 292/216 |
| 5,688,004 | 11/1997 | Karge | 292/341.17 |

*Primary Examiner*—B. Dayoan
*Assistant Examiner*—Clifford B Vaterlaus
*Attorney, Agent, or Firm*—Joseph W. Malleck

[57] ABSTRACT

An automotive door latching system can include a first latch for locking one vehicle door, a second latch for locking a second vehicle door, and an electric switch controlled by the first switch for supplying current to an electrically-operated latch release means associated with the second latch. The latching system requires that the first latch be in the door release state before the second latch can be moved to the door release state. Consequently the doors are openable only in a predetermined sequence.

3 Claims, 1 Drawing Sheet

AUTOMOTIVE DOOR LATCHING SYSTEM

BACKGROUND AND SUMMARY OF THE INVENTION

This invention relates to an automotive door latching system, and particularly to a latching system wherein a latch for one door (or closure) has to be in the unlocked (release) position before the latch for a second door (or closure) can be moved from the locked position to the unlocked position. The system ensures that the two doors can only be opened in a particular sequence; i.e. the first door has to be opened before the second door.

U.S. Pat. No. 5,688,004, issued to S. Karge, discloses a door latching system wherein an upper hatch door at the rear of a vehicle has to be opened before a companion lower hatch door can be opened. Each hatch door latch is operated by an electric motorized drive means. An electric switch is associated with the latch for the upper hatch door so that the motorized drive for the latch on the lower door can only be energized when the upper hatch door is in the open position.

The present invention is concerned with a sequentially-operable door (or closure) latch system having a relatively simple operational mode and construction. The latch for the second door (or closure) is controlled by an electrically-operated latch release means that is in series connection with an electrical switch controlled by the latch for the first door, whereby the second door can be opened only when the first door is in the open position. A second master control switch is in series connection with the electrically-operated latch release means, so that the latch release means is disconnected from the electrical power source when the first door is open and the second door is closed. This feature prevents undesired drain on the battery power source.

Further features of the invention will be apparent from the attached drawings and description of an illustrative embodiment of the invention.

DESCRIPTION OF A PREFERRED EMBODIMENT OF THE INVENTION

Figure 1:
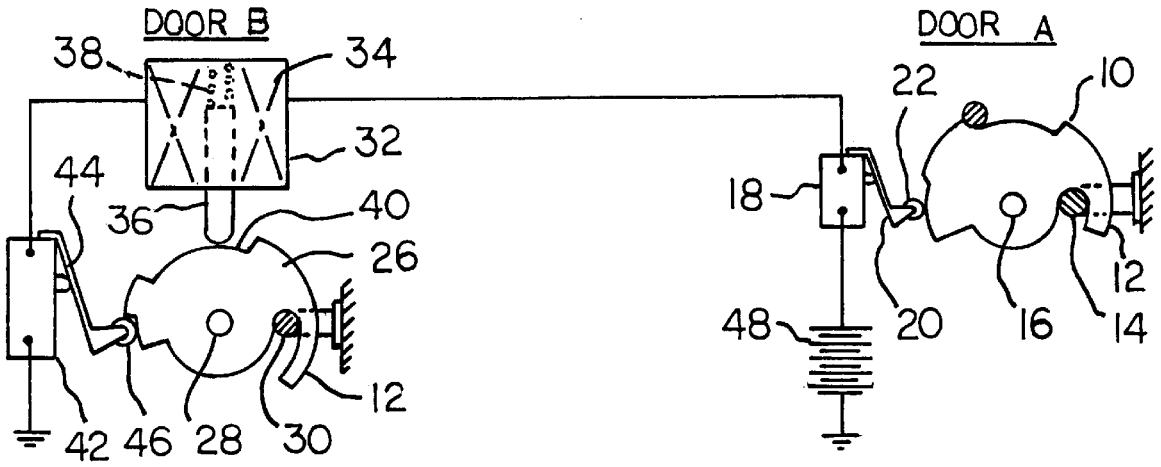
FIG. 1 is a schematic view of a closure latching system embodying the invention, taken with the latches for both closures (doors) in the locking positions.

FIG. 1 shows an automotive door (closure) latching system embodying the invention. The latching system comprises a first rotary latch 10 having an arm 12 adapted to partially encircle a striker 14, whereby the striker is prevented from movement. Latch 10 can be on the door or on the vehicle frame. Shaft 16 extends axially from the latch for rotating the latch from the locking position (FIG. 1) to the release position (FIG. 2).

Figure 2:
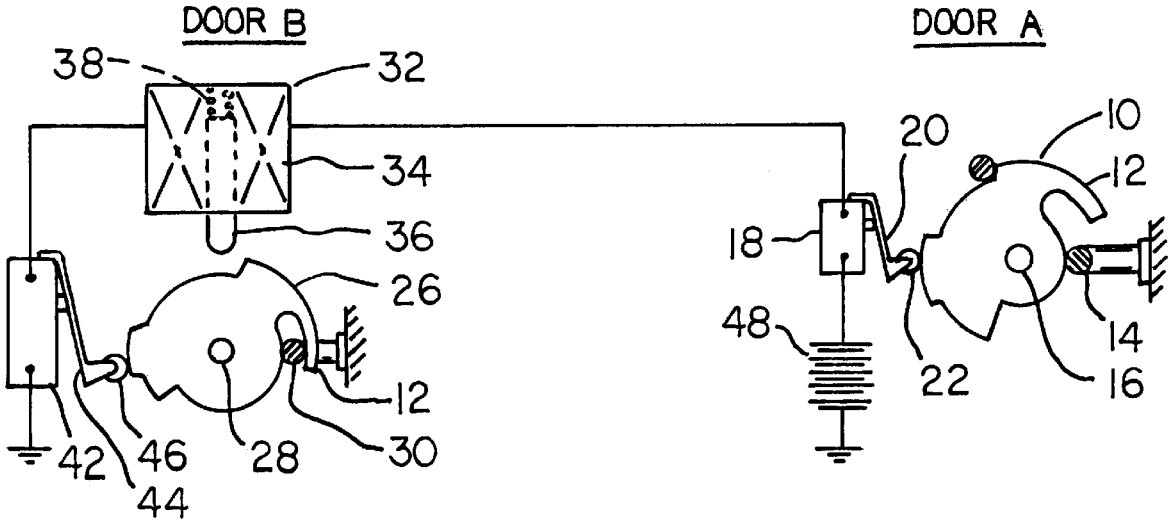
FIG. 2 is a view taken in the same direction as FIG. 1, but with one latch in a release (open) position and the other latch in a locking (closed) condition.

An electric snap switch 18 is located alongside the rotary latch so that latch rotation controls the condition of the switch A switch actuation arm 20 carries a roller 22 that rides on an edge surface of latch 10, whereby rotary motion of the latch operates arm 20 between a circuit-open condition (FIG. 1) and a circuit-closed condition (FIG. 2). The shaft can be attached to a handle, key lock barrel, or other activating device.

The system further includes a second rotary latch 26 for locking, or unlocking, a second door (or closure) on the vehicle. Latch 26 is rotatable around the axis of a latch actuation shaft 28 for locking, or releasing, a striker 30. The latch can be located on the door or on the vehicle frame. FIG. 1 shows latch 26 in a fully locked condition. FIG. 2 shows latch 26 in a transitional condition, still locked but nearing a release state wherein the associated striker 30 is free to move relative to the latch. Shaft 28 can be attached to a handle, key lock barrel, or other activating device.

An electrically-operated latch release means 32 is located alongside rotary latch 26 for controlling the latch 26 movement. When the latch release means is electrically-energized the latch 26 can rotate freely from the locking position (FIG. 1) to the release position (not shown).

Latch release means 32 comprises a solenoid 34, an armature plunger 36, and an internal coil spring 38. When the solenoid is de-energized, spring 38 moves plunger 36 into a recess 40 in the edge of latch 26, whereby the latch is prevented from rotating to the release position. When solenoid 34 is energized, plunger 36 is drawn out of recess 40, whereby latch 26 can be rotated in a counterclockwise direction to the release state.

The latch system further comprises a second master control switch 42 located alongside rotary latch 26 for normally preventing current flow through solenoid 34 (especially when switch 18 is in the FIG. 2 circuit-closed condition). Control switch 42 is a snap switch having an actuating arm 44 equipped with a roller 46 that rides on the edge of rotary latch 26. In the FIG. 1 position switch 42 is in a circuit-open condition, such that solenoid 34 is in a de-energized state. In the FIG. 2 position, arm 44 is deflected by the cam surface on latch 26, so that switch 42 is in a circuit-closed condition.

Solenoid 34 has a series electrical connection with switches 42 and 18, so that if either switch is open the solenoid is de-energized. When both switches are closed the solenoid is energized by the battery power source 48.

FIG. 1 shows both latches 10 and 26 in the locking positions, wherein the associated doors (closures) are closed. FIG. 2 shows latch 10 rotated to the release position wherein the associated door is free for movement to the open position.

In the FIG. 2 position of latch 10 the associated switch 18 is in a circuit-closed condition. When an actuating force is applied to the shaft 28 of latch 26 the latch rotates counterclockwise, so that switch 42 is actuated by arm 44 to a circuit-closed condition, whereby solenoid 34 is energized to move plunger 36 out of recess 40. Latch 26 can thereby rotate counterclockwise beyond the FIG. 2 position to a release state, wherein striker 30 is free for movement relative to latch 26. The associated second door is free for movement to the open position.

With the illustrated latch system, door B cannot be opened while door A is closed. Door A has to be opened first. Since the latches 10 and 26 are connected electrically (not mechanically), the two doors A and B can be at any desired locations on the vehicle; the doors do not have to be proximate to one another.

As shown in the drawings, master control switch 42 is cam-operated by latch 26. However, switch 42 could be manually operated, in which case switch 42 would be operated to the circuit-closed condition as the initial step in the process of moving latch 26 to the release position. The purpose for switch 42 is to prevent current drain on the battery power source, especially when switch 18 is in the circuit-closed condition (as in FIG. 2).

The drawings necessarily show a specific form that the invention can take. However, it will be appreciated that the invention can take various forms and configurations.

What is claimed is:

1. An automotive closure latching system comprising:

a first rotary latch (10) for releasably locking a first closure; said first latch having a locking position and a release position; said first latch having a first cam surface;

a first electric switch (18) having an actuator engaged with said first cam surface so that when the first latch is moved to the release position, said first switch is operated by said cam surface to a circuit-closed condition;

a second rotary latch (26) for releasably locking a second closure; said second latch having a locking position and a release position; said second latch having a second cam surface;

a second master control electric switch (42) in series connection with said first switch; said second switch having an actuator engaged with said second cam surface so as to be in a circuit-open condition when said second latch is in its locking position; said second cam surface being effective to operate said second switch to a circuit-closed condition during initial movement of said second latch toward its release position; and an electro-magnetic means (32) for releasing said second latch; said release means being in series connection with said first and second switches so that said release means is electrically energized only when both switches are in the circuit-closed conditions; said release means having a plunger (36) movable from a latch-obstructing position to a non-obstruct position only when said release means is energized, whereby said second latch can be moved to its release position only when the first switch is in the circuit-closed condition.

2. An automotive closure latching system comprising:

a first latch for releasably locking a first closure, said first latch having a locking position and a release position;

a second latch for releasably locking a second closure, said second latch having a lock position and a release position;

a first electric switch controlled by said first latch so that when said first latch is in the release position said first switch is in a circuit-closed condition;

an electrically-operated release means for said second latch in series connection with said first switch, whereby said second latch is freely moveable between the locking position and the release position only when said first switch is in the circuit-closed condition; and a second master control electric switch in series connection with said electrically-operated release means, whereby said release means is electrically energized when said second latch is moving from its locking position to its release position.

3. An automotive closure latching system comprising:

a first latch for releasably locking a first closure, said first latch having a locking position and a release position;

a second latch for releasably locking a second closure, said second latch having a locking position and a release position;

a first electric switch controlled by said first latch so that when said first latch is in the release position said first switch is in a circuit-closed condition;

an electrically-operated release means for said second latch in series connection with said first switch, whereby said second latch is freely moveable between the locking position and the release position only when said first switch is in the circuit-closed condition; and a second master control electric switch in series connection with said electrically-operated release means; said second switch being controlled by said second latch so that initial movement of said second latch from its locking position causes said second switch to electrically energize the electrically-operated release means.

* * * * *